US005799806A

United States Patent [19]

Cullity

[11] Patent Number: 5,799,806

[45] Date of Patent: Sep. 1, 1998

[54] LIFTING DEVICE WITH COUNTERWEIGHT

[75] Inventor: Richard E. Cullity, Atlantic, Iowa

[73] Assignee: Skyjack Equipment Inc., Atlantic, Iowa

[21] Appl. No.: 797,692

[22] Filed: Jan. 31, 1997

[51] Int. Cl.[6] ..... B66C 23/76

[52] U.S. Cl. ..... 212/196; 212/195

[58] Field of Search ..... 212/195, 196

[56] References Cited

U.S. PATENT DOCUMENTS

| | | | |
|---|---|---|---|
| 252,672 | 1/1882 | Jewett | 212/195 |
| 1,245,186 | 11/1917 | Brothers | 212/196 |
| 2,036,386 | 4/1936 | Andersen | 212/195 |
| 2,198,793 | 4/1940 | Schroeder | 212/195 |
| 2,364,493 | 12/1944 | Ulinski | 212/195 |
| 3,362,432 | 1/1968 | Jameson | 212/196 |
| 3,513,997 | 5/1970 | Heyer et al. | 212/195 |

FOREIGN PATENT DOCUMENTS

| | | | |
|---|---|---|---|
| 657864 | 4/1965 | Belgium | 212/196 |

*Primary Examiner*—Thomas J. Brahan

*Attorney, Agent, or Firm*—Zarley, McKee, Thomte, Voorhees, & Sease

[57] ABSTRACT

A lifting device which includes a frame and an elongated boom having a lower end pivotally connected to the frame along a pivot axis. The lower end of the boom has a counterweight connected thereto offset from the pivot axis. The counterweight has a center of gravity which is movable with respect to the pivot axis of the boom. The counterweight can be freely pivotal, fixed, or partially fixed with respect to the boom. When linkage is provided between the counterweight and the boom, the counterweight can be rolled or tilted so as to move the counterweight center of gravity with respect to the pivot axis of the boom.

7 Claims, 11 Drawing Sheets

36A
76A
76
64
66
74
70A
72A
70
72
78
18
16
30
74
68
72
73
70
82
82
80
36B
76B
40

LIFTING DEVICE WITH COUNTERWEIGHT

BACKGROUND OF THE INVENTION

1. Field Of The Invention

The present invention relates to the field of lifting devices having a boom which can be moved with respect to a frame and pivoted to various angles with respect to a horizontal plane. More particularly, this invention relates to a counterweight system wherein the counterweight has a center of gravity generates an anti-tipping moment to help prevent the lifting device from tipping over even when the boom is extended, articulated, angled and/or loaded.

2. Problems In The Art

It is well known in the art of boom operated lifting devices that such devices are prone to tip over when the boom is extended, articulated, angled and/or loaded. Often the size and weight of the machine is selected to enhance its stability. Unfortunately, such an approach lacks flexibility and promotes inefficiency in the design. Therefore, there is a need for a simple, flexible and cost efficient solution to the overturning problem.

FEATURES OF THE INVENTION

A primary object of the present invention is the provision of a means for counterweighting a boom operated lifting device.

A further object of the present invention is the provision of a counterweight system that fits within the turret of the machine.

A further object of the present invention is the provision of a counterweight system wherein the center of gravity of the counterweight is offset from the pivot axis of the boom so as to create an anti-tipping moment.

A further object of the present invention is to provide a counterweight system wherein the counterweight is pivotally hung from the lower end of the boom.

A further object of the present invention is the provision of a counterweight system wherein a linkage means interconnects the boom and the counterweight so as to move the counterweight, and therefore its center of gravity, when the boom is pivoted up or down.

A further object of the present invention is a provision of a counterweight system wherein a counterweight linked to the boom has wheels and rolls along the base plate of the turret in response to the pivoting of the boom.

A further object of the present invention is the provision of a counterweight system wherein the counterweight can pivot freely to a desired angle in one direction and thereafter acts as a fixed counterweight for the further movement in that direction.

These and other objects will be apparent to one skilled in the art from the drawings, the claims, and the description which follows.

SUMMARY OF THE INVENTION

The present invention relates to a lifting device that includes a frame, an elongated boom having a lower end pivotally connected to the frame along a pivot axis. A counterweight is pivotally connected to the first end of the boom and offset from the pivot axis. The counterweight has a center of gravity which moves in response to the pivoting of the boom. When linkage is provided between the counterweight and the boom, the counterweight can be rolled or tilted so as to move the counterweight center of gravity with respect to the pivot axis of the boom.

DETAILED DESCRIPTION OF THE PREFERRED EMBODIMENTS

Figure 1:
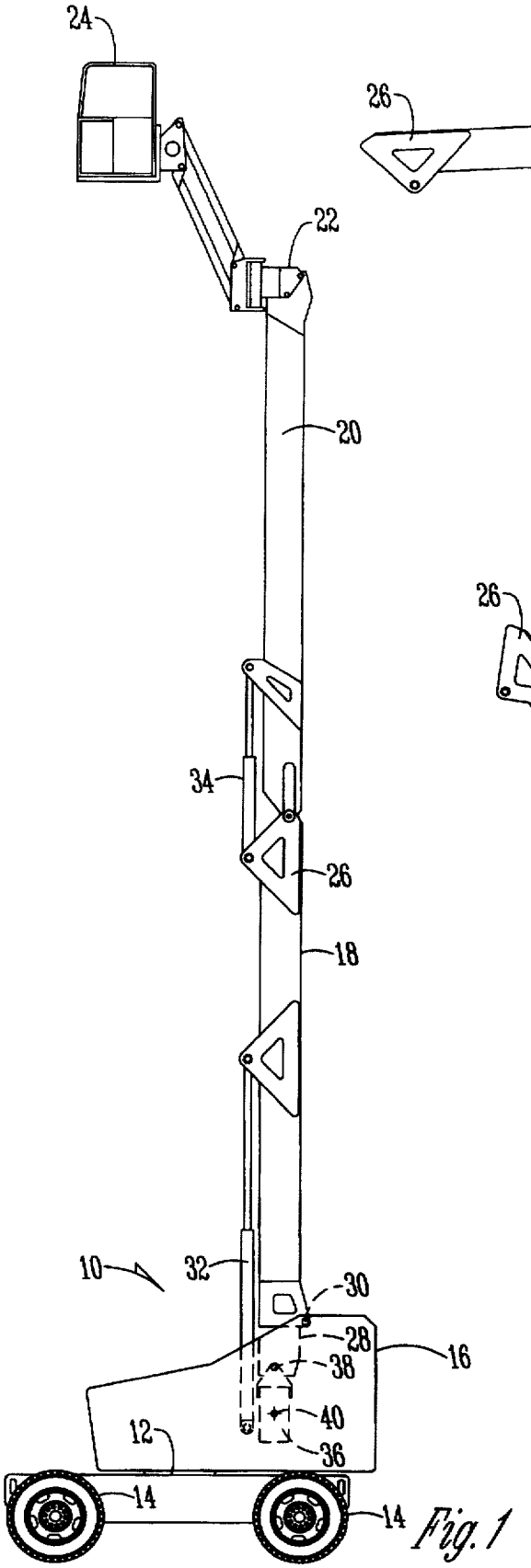
FIG. 1 is a side elevation view of a mobile lifting device equipped with one embodiment of the counterweight system of the present invention and having the secondary boom fully extended so that the boom is approximately vertical.

FIG. 1 shows a lifting machine or lifting device 10. The lifting device can be on a stationary or mobile frame. Here, the frame 12 is movable with respect to a supporting surface or the ground (not shown) by virtue of a plurality of wheels 14 which are rotatably mounted on the frame 12 and driven by a conventional engine (not shown). A turret 16 is rotatably mounted on the frame 12.

The lifting device 10 includes a main boom 18, a secondary boom 20 and a jib boom 22 which is telescopically received in the secondary boom 20. An operator's cage 24 is conventionally mounted to the jib boom 22. The secondary boom is articulatable with respect to the main boom. The basic boom structure described above is conventional and not the subject of this invention.

The main boom 18 is elongated and has an upper end 26 and a lower end 28 which is pivotally connected to the turret 16 along a substantially horizontal pivot axis 30. Hydraulic cylinders 32, 34 pivot and articulate booms 18, 20, respectively. The pivoting of the main boom 18 about the pivot axis 30 by the cylinder 32 is illustrated in FIGS. 2 and 3.

Figure 3:
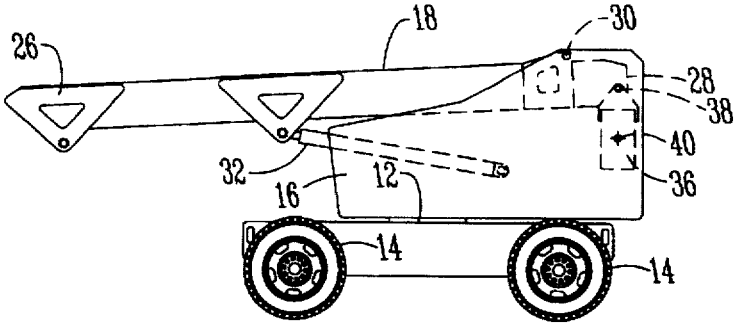
FIG. 3 is a side elevation view similar to FIG. 2, except the boom has been pivoted downward to a substantially horizontal position.

FIG. 3 shows the main boom 18 pivoted to a substantially horizontal position, while FIG. 3 shows the main boom 18 pivoted to an acute angle with respect to horizontal. The secondary boom 20, the jib boom 22 and the operator's cage 24 have been removed from FIGS. 2 and 3 so as to focus attention on the pivoting of the main boom 18.

Figure 2:
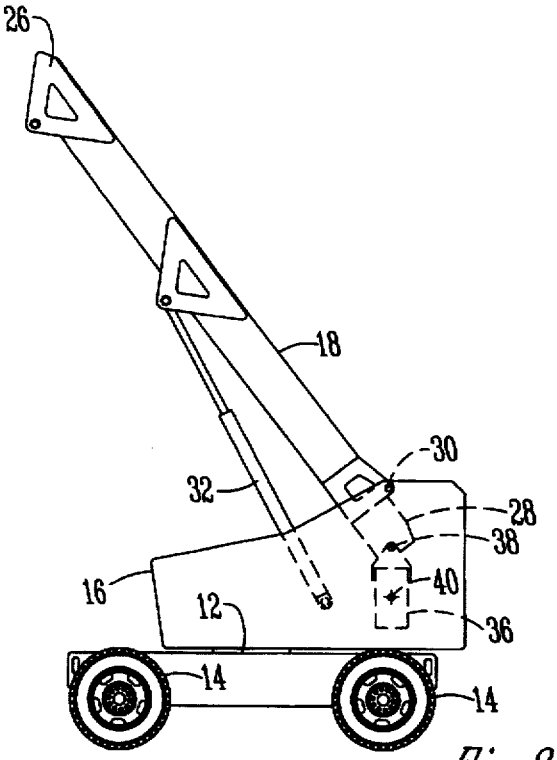
FIG. 2 is a side elevation view of the device of FIG. 1 with the upper part of the boom removed and the boom moved to an acute angle with respect to horizontal.

In FIGS. 1–3, a counterweight 36 is hung from the lower end 28 of the main boom 18 so as to pivot about a pivot axis 38 within the turret 16. The counterweight 36 is hung so that the pivot axis 38 (defined by a pivot shaft or two pivot pins) preferably is offset from the pivot axis 30 of the main boom 18. Thus, when the main boom is in a substantially horizontal position (FIG. 3), the counterweight hangs near the rear of the turret 16 and is approximately perpendicular to the boom 18. When the boom 18 is pivoted upward (FIG. 2), the counterweight 36 swings downwardly and forwardly with the lower end 28 of the boom 18. The counterweight 36 still hangs vertically, but its center of gravity 40 has moved downward and forward. In FIG. 1, the boom 18 has been pivoted to an angle of approximately 90° with respect to horizontal. The counterweight 36 swings even farther forward so that the center of gravity 40 and the pivot axis 38 are offset in front of the pivot axis 30.

Figure 9:
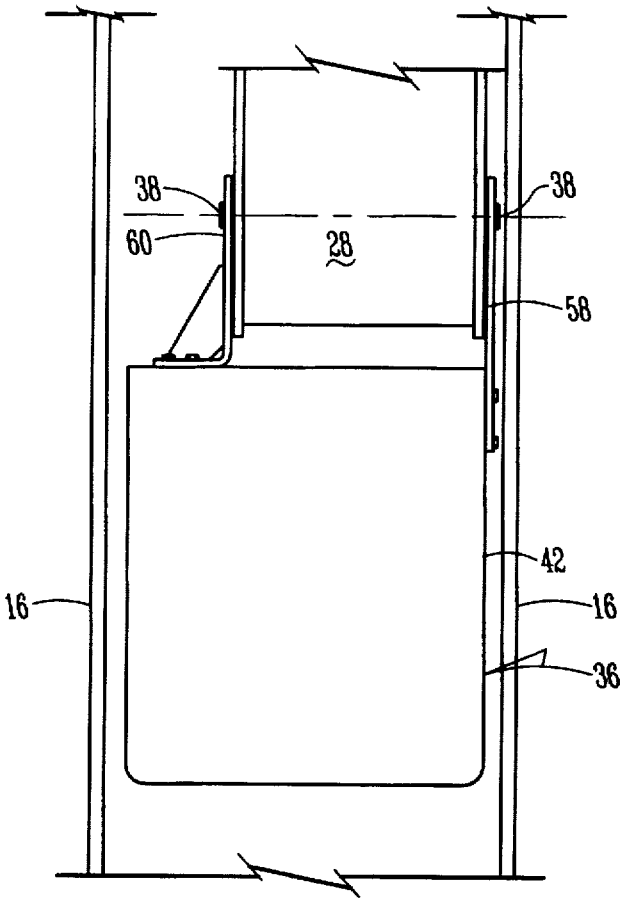
FIG. 9 is a front elevation view of the counterweight of FIG. 5 showing the mounting of the counterweight to the main boom.

As seen in FIGS. 5–9, the counterweight 36 comprises a canister 42 filled with lead or another suitably heavy material. The container 42 has a bottom wall 44, a plurality of side walls 46, 48, 50, 52, and a top wall 54 with an opening 56 therein. A cover 5 can be used to plug the opening 56. Mounting brackets 58 and 60 attached to the container 42 as shown and extend upwardly on either side of the opening 56. Mounting brackets 58, 60 each include an opening 62 therein for receiving the pivot shaft 30. The mounting brackets 58, 60 are spaced apart sufficiently to allow the lower end 28 of the boom 18 to be inserted therebetween, as best seen in FIG. 9. The pivot pins 38 pass through the mounting brackets 58, 60 and into the lower end 28 of the boom 18 to form a pivotal connection between the boom 18 and the container 42. In this embodiment, the container 42 freely swings or pivots from the boom 18 because ample clearance is provided therebetween.

Figure 4:
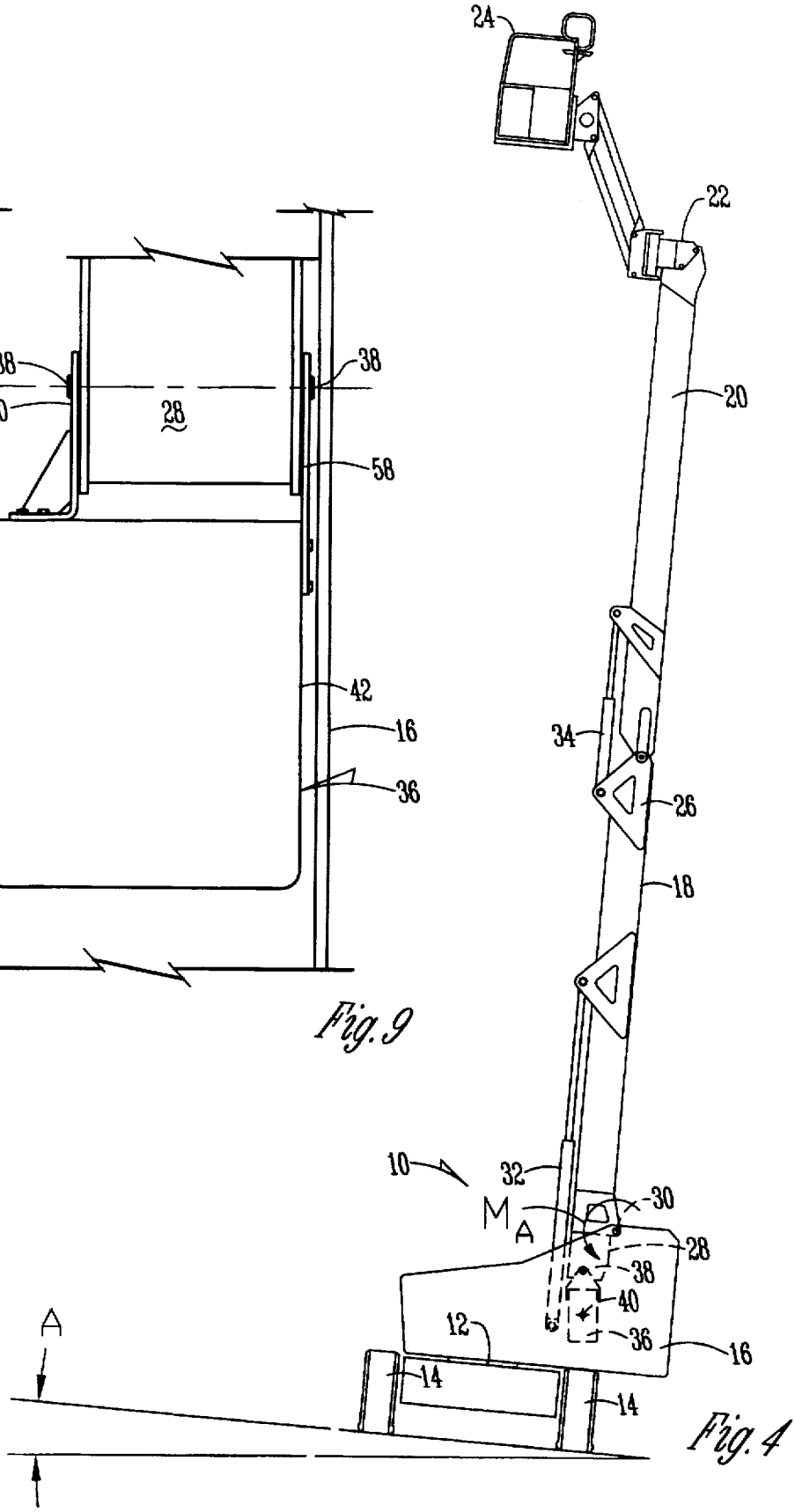
FIG. 4 is a rear elevation view of the device of FIG. 1 as it encounters a side incline.
Figure 7:
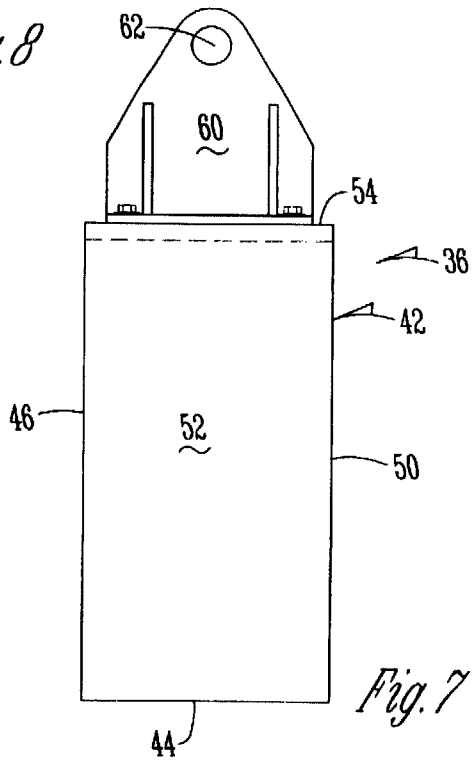
FIG. 7 is a left side elevation view of the counterweight FIG. 5.
Figure 8:
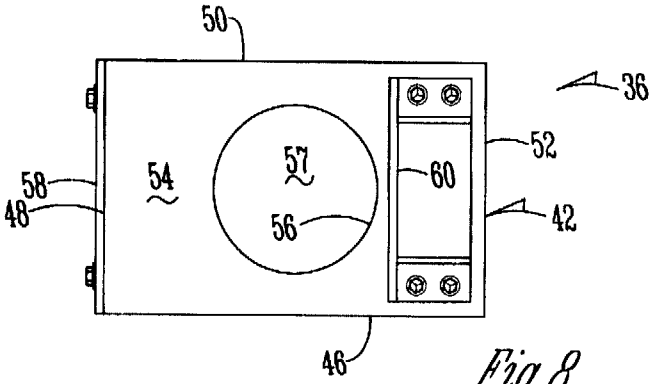
FIG. 8 is a top view of the counterweight of FIG. 5.
Figure 5:
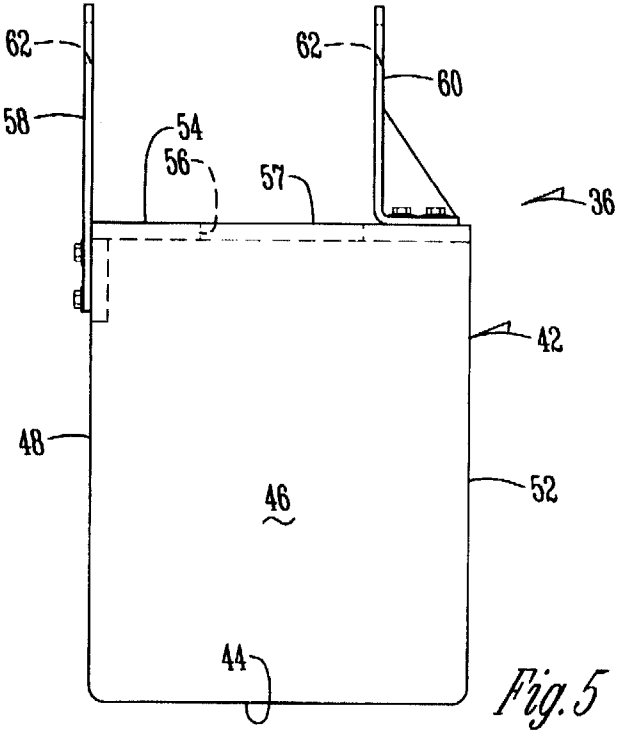
FIG. 5 is a rear elevation view of one embodiment of the counterweight of this invention.
Figure 6:
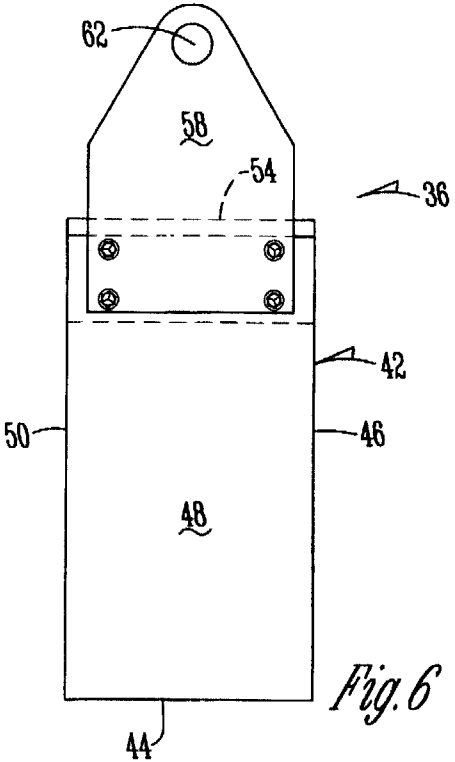
FIG. 6 is a right side elevation view of the counterweight of FIG. 5.

FIG. 4 illustrates the operation of the counterweight system of this embodiment. The lifting device 10 rests on an inclined surface, as indicated by the angle A. This places the main boom 18 at an obtuse angle with respect to horizontal. However, the counterweight 36 freely pivots to a true vertical position. Because the pivot axis or shaft 38 is offset from the pivot axis or shaft 30 of the main boom 18, an additional counterclockwise or anti-tipping moment is developed.

The advantages of the freely pivotal embodiment of FIGS. 1–9 are that a relatively small turret volume is required to accommodate the displacement of the counterweight 36; the distances between the center of gravity 40 and the counterweight pivot axis 38 and between the counterweight pivot axis 38 and the main boom pivot axis 30 are fixed or constant, making results easy to predict; larger anti-tipping moments are generated when needed most (when the boom is nearly horizontal); and anti-tipping moments are available to prevent both forward-tipping and back-tipping.

Figure 10A:
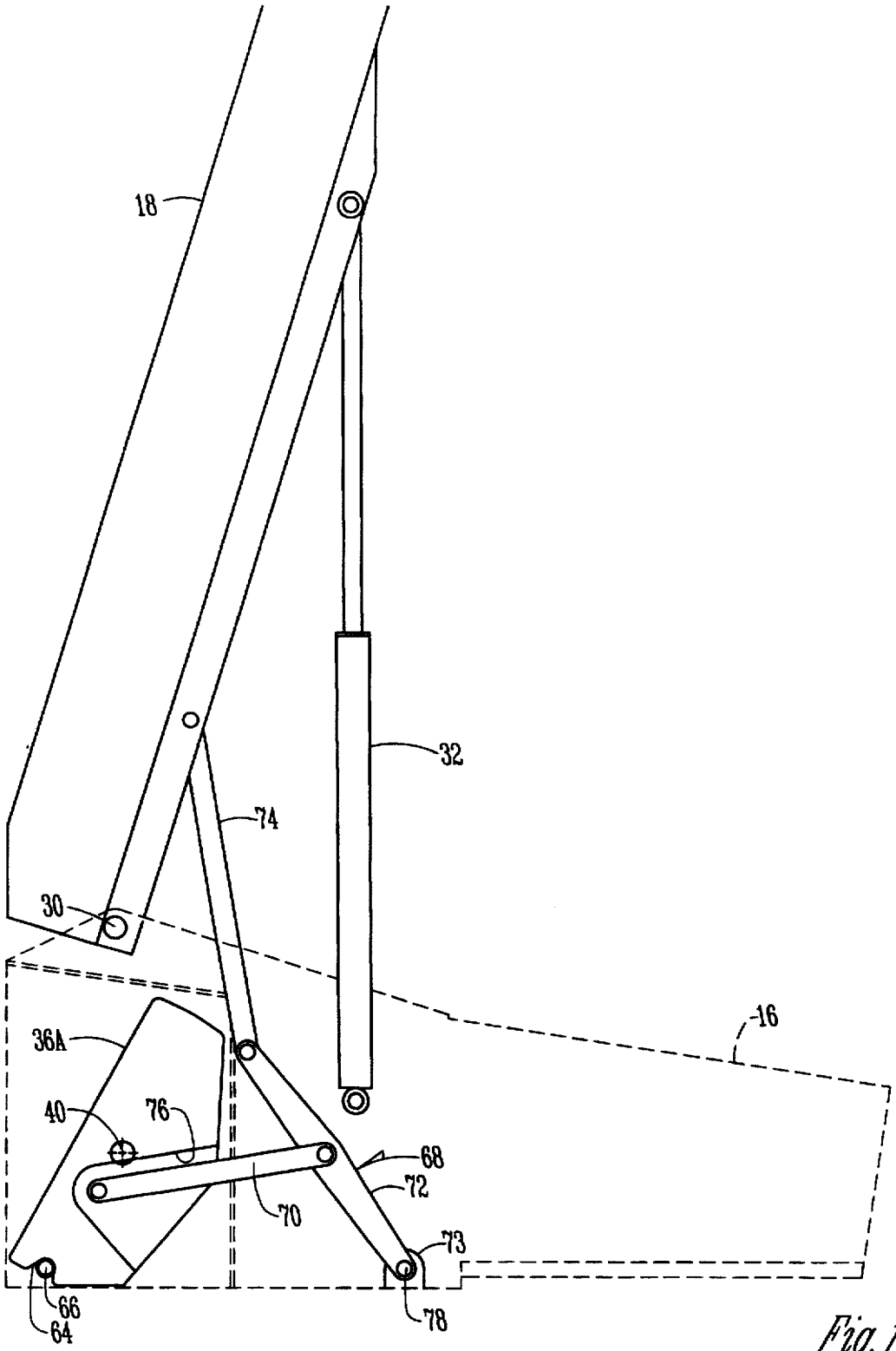
FIG. 10A is a simplified side view of another embodiment of this invention with the main boom pivoted upward. In response, a linkage interconnecting the counterweight and the main boom tilts the counterweight clockwise about a shaft in the turret to the position shown.

Another embodiment of the present invention is shown in FIG. 10A. The counterweight 36A is disposed within the turret 16, as before. However, the lower portion of the counterweight 36A has a groove 64 extending transversely thereacross. The groove 64 receives a fixed shaft 66, preferably mounted in the turret 16 and extending horizontally and transversely thereacross.

Figure 10B:
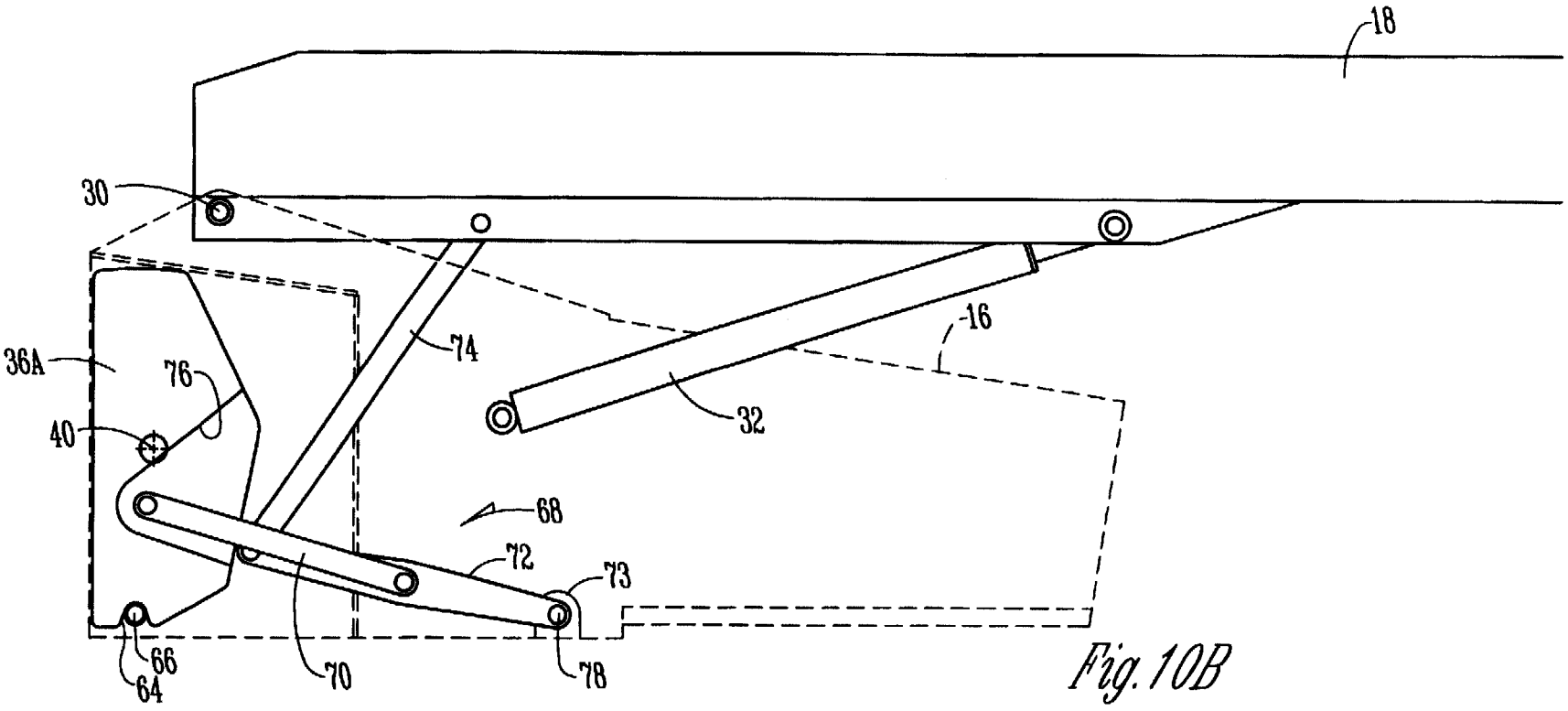
FIG. 10B is a simplified side view of the embodiment of FIG. 10A wherein the main boom has been pivoted to a substantially horizontal position and, in response, the counterweight has been pivoted counterclockwise to the position shown.
Figure 10C:
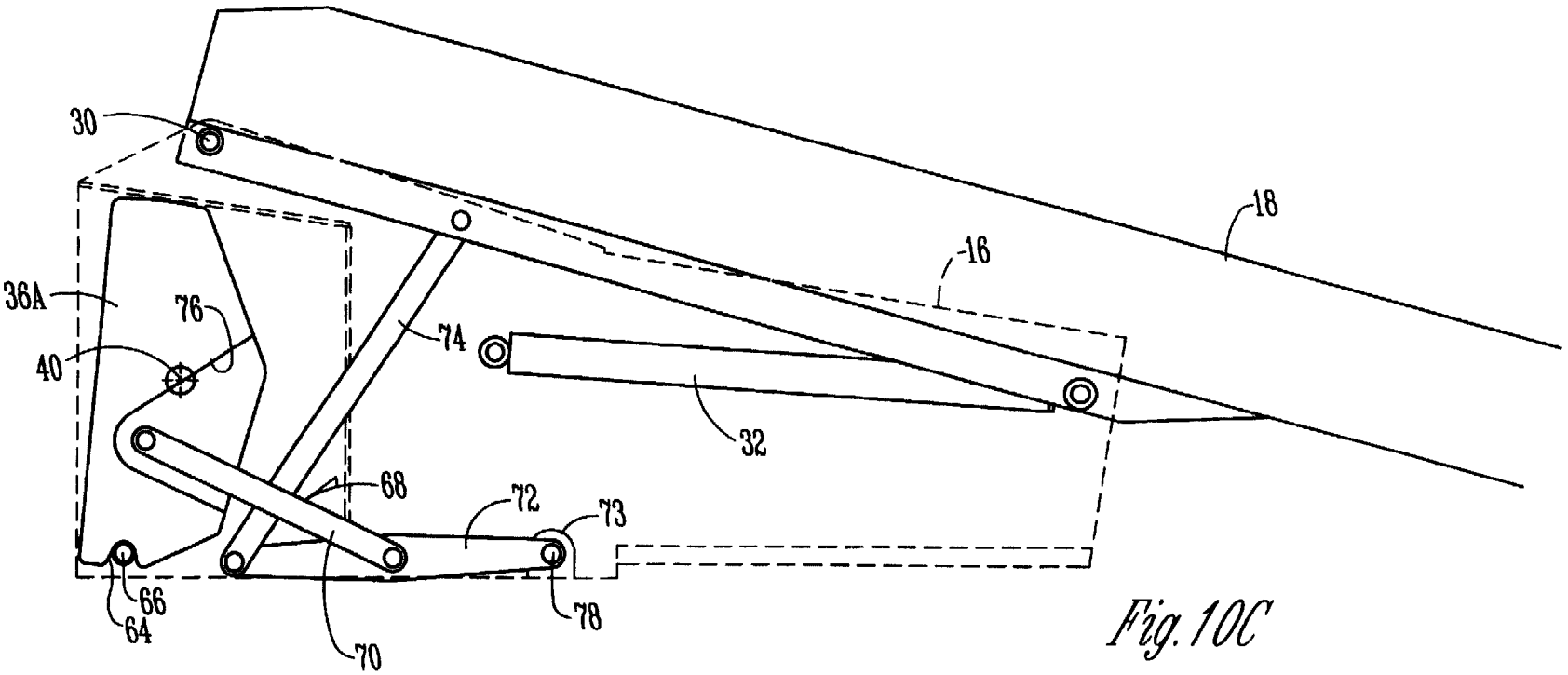
FIG. 10C is a simplified side view similar to 10A, but the main boom has been pivoted beyond horizontal and the counterweight pivoted clockwise in response.
Figures 10D, 11A:
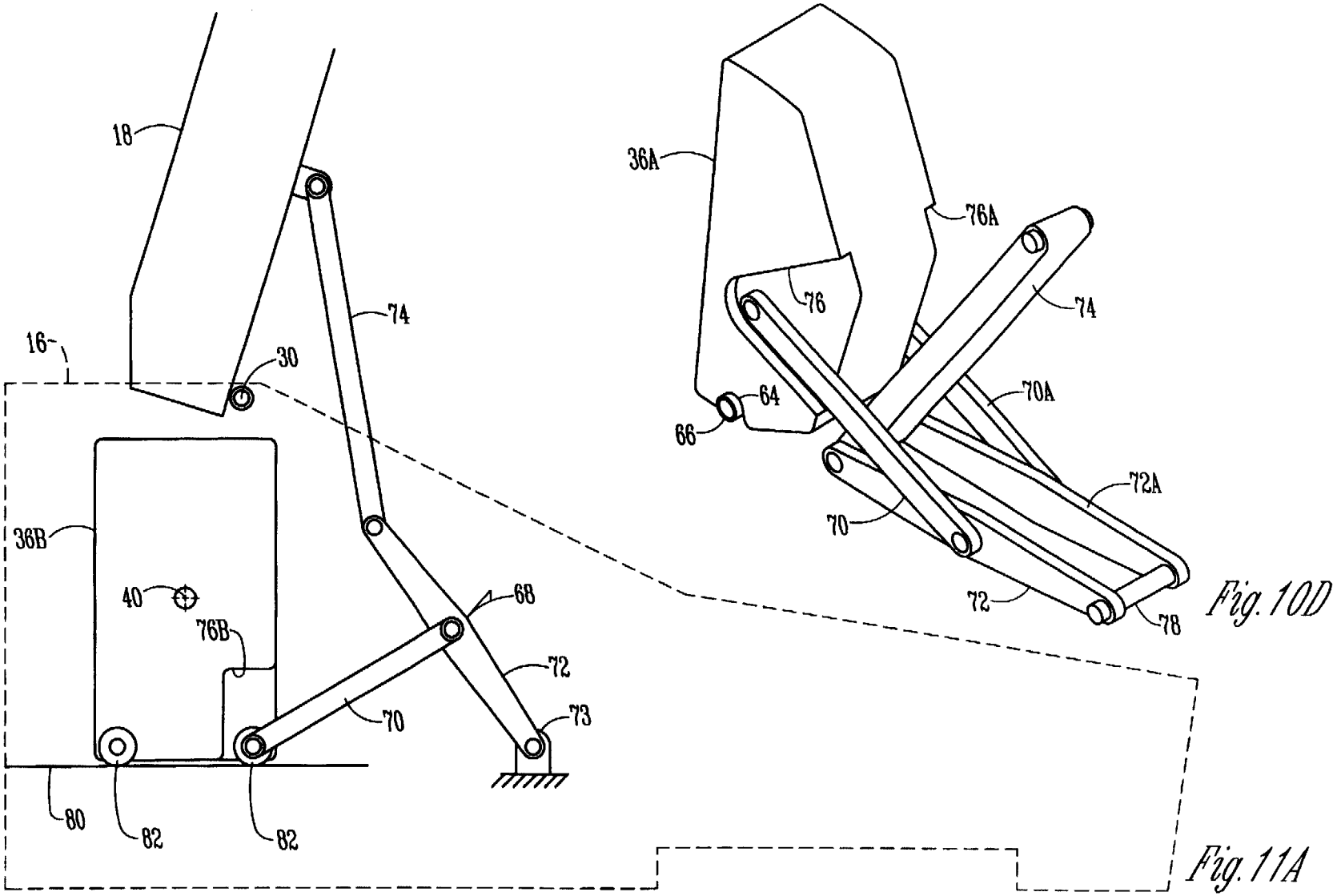
FIG. 10D is a perspective view which shows the counterweight and linkage arrangement for the tilting counterweight embodiment of 10A.
FIG. 11A is a side elevation view of another embodiment of this invention wherein linkage means interconnect the main boom with a counterweight having wheels thereon, and the counterweight rolls forward in response to the pivoting of the main boom.

Linkage means 68 interconnect the counterweight 36A with the main boom 18. The linkage means 68 comprises a plurality of elongated arms 70–74. Arm 70 has one end pivotally connected to the counterweight 36A, as best seen in FIG. 10D. The other end of the arm 70 is pivotally connected to the arm 72 between its ends. As best seen in FIGS. 10A–10C, one end of the arm 72 is pivotally attached to a fixed support 73 in the turret 16. The opposite end of the arm 72 is pivotally attached to the lower end of the arm 74. The upper end of the arm 74 is pivotally connected to the main boom 18 forward of the pivot axis 30. A depression or cut out area 76 is provided on the counterweight 36A to accommodate the normal range of movement of the arm 70 (see FIG. 10D).

A second set of parallel arms 70A, 72A can be connected to the opposite side of the counterweight 36A to provide additional structural strength and rigidity. A pivot shaft 78 mounts the arms 72, 72A to each other and to the turret 16 at the support 73. A depression 76A is also provided on the counterweight 36A.

In this embodiment, the linkage means 68 tilts the counterweight 36A about the shaft 66 in response to the pivoting of the main boom 18. FIG. 10A shows the position of the counterweight 36A when the main boom 18 is pivoted to a substantial acute angle, approximately 75° for illustration. FIG. 10B shows the position of the counterweight 36A once the main boom 18 is in a substantially horizontal position. FIG. 10C shows the position of the counterweight 36A when the main boom 18 is positioned approximately 15° below horizontal.

Figure 11B:
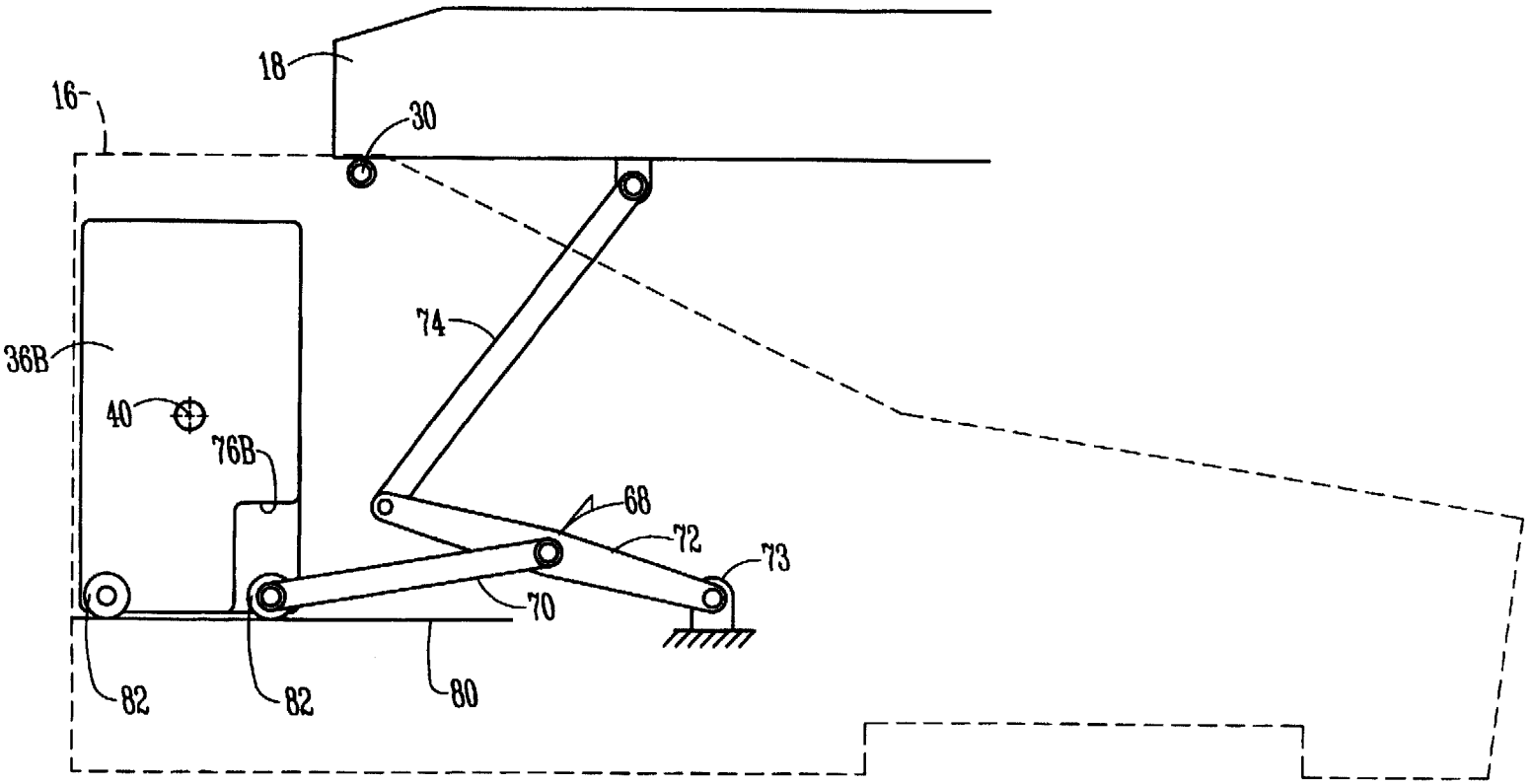
FIG. 11B is a side elevation view of the embodiment of FIG. 11A wherein the main boom has been pivoted downward and the counterweight has rolled rearwardly in response.

Another embodiment of the present invention is shown in FIGS. 11A–11B. A preferably horizontal supporting surface or bast plate 80 extends through a portion of the turret 16. The counterweight 36B has a plurality of wheels 82 rotatably attached thereto. The arm 70 is attached at or near one of the forward wheels 82. A depression 76B is provided in the counterweight 36B to accommodate the swinging movement of the arm 70. In this "rolling embodiment", the rest of the connections are substantially the same as in the "tilting embodiment" previously described.

FIG. 11A shows that the linkage means 68 has pulled or rolled the counterweight 36B forward in response to the pivoting of the main boom 18. FIG. 11B illustrates that the linkage means 68 rolls the counterweight 36B rearwardly when the main boom 18 is lowered. Again, parallel linkage arms can be provided on the opposite side of the counterweight 36B for additional strength and rigidity. The freely pivotal and tilting counterweight embodiments fit better in small machines (with small turrets) than the rolling counterweight embodiment, which generally requires more space.

Figure 12C:
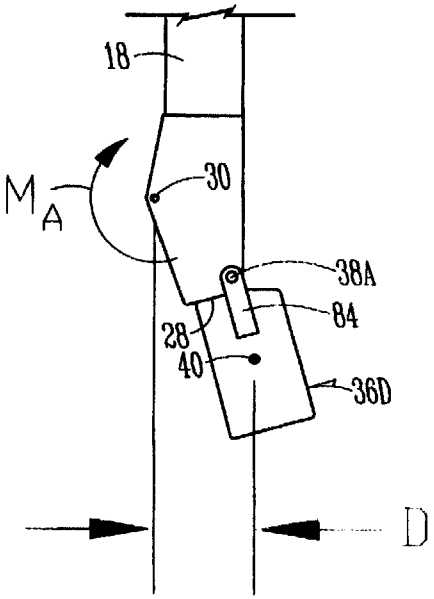
FIG. 12C is a side elevation view of the embodiment of FIG. 12A, but shows the main boom pivoted to an angle of approximately 90° with respect to horizontal and the counterweight still restricted by its abutment with the main boom.
Figure 12B:
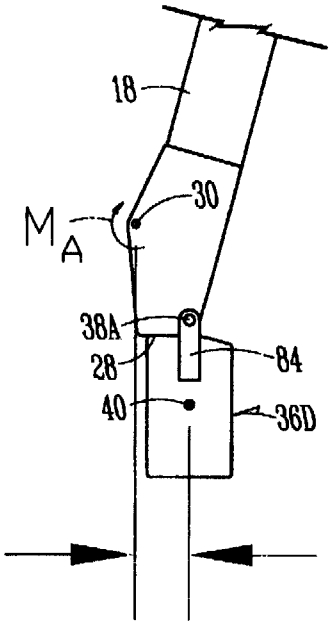
FIG. 12B is a side elevation view of the embodiment of FIG. 12A, but the main boom has been pivoted to an angle of approximately 75° with respect to horizontal, thereby causing the main boom and the counterweight to abut each other and restrict the pivoting of the counterweight.
Figure 12A:
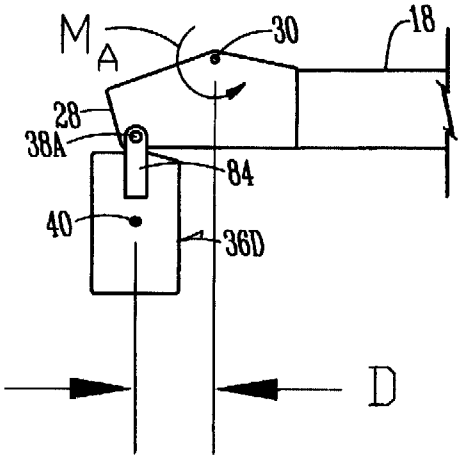
FIG. 12A is a side elevation view showing an embodiment wherein the counterweight and main boom are adapted to abut each other so as to restrict the pivoting of the counterweight under certain conditions.

FIGS. 12A–12C illustrate another embodiment of the present invention in which the counterweight 36D is mounted closer to the lower end 28 of the main boom 18 such that the pivoting of the counterweight is free at some angles of the main boom and restricted at other angles of the main boom.

FIGS. 12A shows that the pivot axis 38A and the counterweight 36D are relatively close together, yet far enough apart that the counterweight 36D pivots freely when the main boom 18 is in a substantially horizontal position.

With the boom 18 in a substantially horizontal position, the horizontal distance D between the center of gravity 40 and the pivot axis 30 is relatively large. However, when the main boom 18 is pivoted to an angle of approximately 75° from horizontal, the counterweight 36D abuts the lower end 28 of the boom 18 as shown in FIG. 12B. The distance D decreases as shown in FIG. 12A. FIG. 12C shows the main boom 18 pivoted to an angle of approximately 90° with respect to horizontal. Due to the fact that the counterweight 36D has remained in contact with the lower end 28 of the main boom 18, the horizontal distance D between the center of gravity 40 and the pivot axis 30 has actually increased. A freely pivoting counterweight would have continued to decrease the distance D. Generally, the greater the distance D, the greater the anti-tipping moment $M_A$. The increased anti-tipping moment is particularly useful at the higher boom angles where tipping would otherwise be likely to occur.

Of course, those skilled in the art will appreciate that there are a variety of ways to achieve abutment between the top surfaces of the counterweight and the lower end of the boom, including but not limited to shortening the length of the strap 84 and/or raising surfaces on one or both of the lower end 28 of the main boom 18 and the top of the counterweight 36D. The particular angle at which abutment occurs can be preselected to meet other design requirements of the machine, such as size, weight, boom weight, boom extension, etc.

Figure 13C:
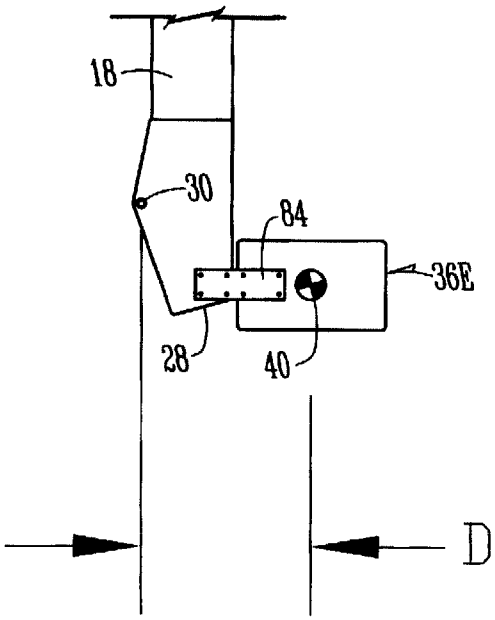
FIGS. 13B and 13C are side elevation views of the embodiment of FIG. 13A, but show the main boom raised to an angle of approximately 75° and 90°, respectively, with respect to horizontal.
Figure 13B:
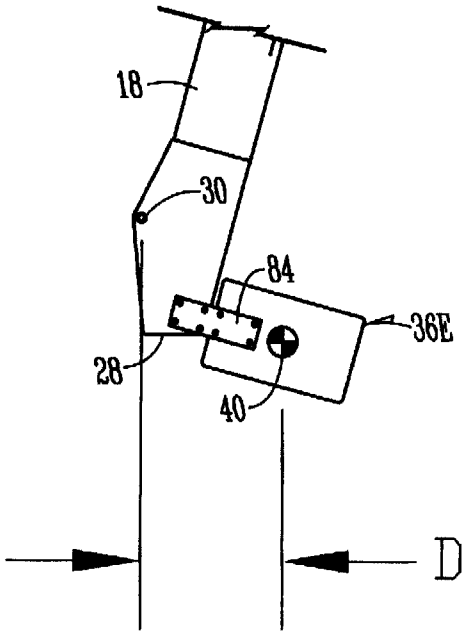
Figure 13A:
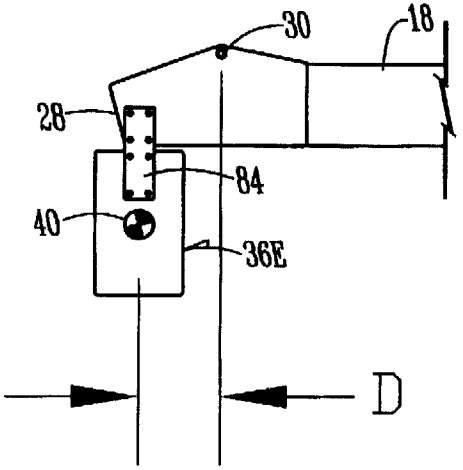
FIG. 13A is a side elevation view of another embodiment of the present invention wherein the counterweight is fixed on the end of the main boom.

FIGS. 13A–13C illustrate another embodiment of the present invention. In this embodiment, the strap 84 is rigidly attached to both the lower end 28 of the main boom 18 and the counterweight 36E. For purposes of illustration, the counterweight 36E can be attached with its center of gravity 40 at the same distance D as shown in FIG. 12A. As the boom 18 is pivoted, the distance D at first decreases until the pivot axis 30 and the center of gravity 40 are vertically aligned, then increases as reflected in FIG. 13B. FIG. 13C shows that, with the fixed counterweight 36E, the distance D continues to increase until the main boom 18 extends approximately 90° with respect to horizontal. As can be understood from FIGS. 1–4; 10A–10C; and 11A–11C, the present invention applies to booms with a pivot axis above the boom, below the boom, or anywhere in between.

Figure 14:
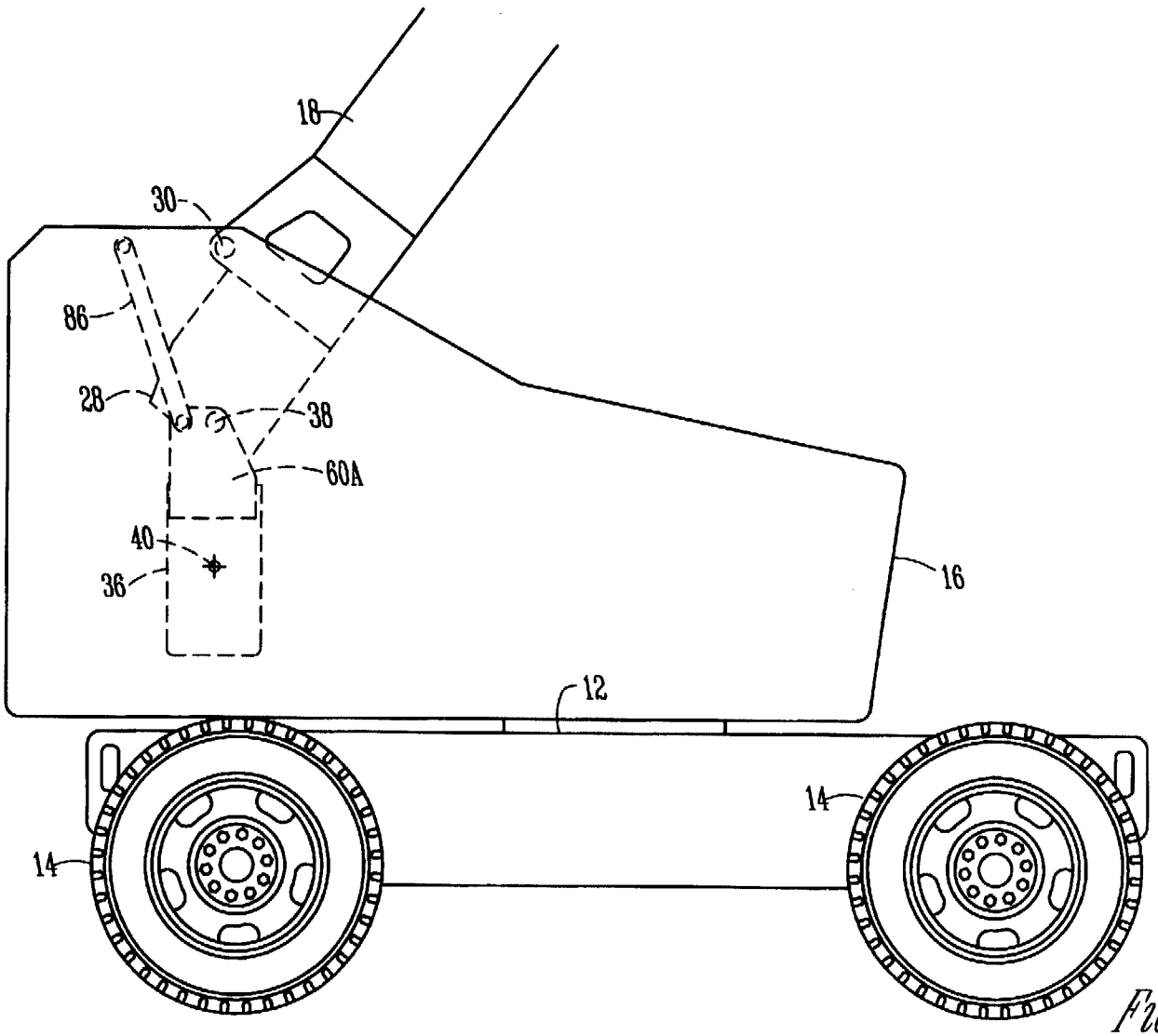
FIG. 14 is a side elevation view of another embodiment of the present invention wherein a snubber link is included to provide additional control of the counterweight movement.

In the embodiment of FIG. 14, a snubber link 86 is added to help better control the movement of the counterweight 36. One end of the snubber link 86 pivotally connects to a mounting bracket 60A near the pivot axis 38 of the counterweight 36. The other end of the snubber link 86 is pivotally connected to the turret 16 near the pivot axis 30. The snubber link 86 limits or dampens the swinging of the counterweight 36 during driving, transporting and operating of the machine. Functionally, the snubber link can also accomplish the same results as the "abutment embodiments" of FIGS. 12A–12C. The counterweight pivots freely until the snubber link becomes limiting, then the counterweight is restricted so as to "kick" or move with the boom. The location of the pivot point on the turret determines how the counterweight will pivot during the total boom arc. Swinging or "kicking" the counterweight more creates larger restoring or anti-tipping moments at certain positions of the boom.

Based upon the foregoing, the present invention at least achieves the stated objectives.

In the drawings and specification there has been set forth a preferred embodiment of the invention, and although specific terms are employed, these are used in a generic and descriptive sense only and not for purposed of limitation. Changes in the form and the proportion of parts, as well as in the substitution of equivalents, are contemplated as circumstances may suggest or render expedient without departing from the spirit or scope of the invention as further defined in the following claims.

What is claimed is:

1. A lifting device comprising:

a frame;

an elongated boom having a lower end pivotally connected to the frame along a single pivot axis, the lower end of the boom constituting a first end of the boom;

a freely swinging counterweight connected directly only to the lower end of the boom and offset from the pivot axis so that the counterweight has a center of gravity that moves with respect to the pivot axis in response to the pivoting of the boom about the pivot axis;

said pivot axis being non-movable with respect to the boom;

the frame having a turret rotatably mounted thereon and the boom being pivotally connected to the turret and rotatable therewith; and the counterweight being disposed within the turret.

2. The lifting device of claim 1 wherein said counterweight being directly pivotally connected to the first end of the boom on a pivotal axis that is non-movable with respect to the boom.

3. The lifting device of claim 2 wherein the counterweight is pivotally connected to respective sides of the boom by a pair of spaced apart mounting brackets that straddle the boom such that the counterweight pivots freely between the brackets throughout at least 90° of movement of the boom.

4. The lifting device of claim 3 wherein the counterweight comprises a canister having a bottom wall, a plurality of side walls joined to each other and to the bottom wall, and a top wall joined to the side walls and having an opening therein for filling the canister with a dense material.

5. The lifting device of claim 1 wherein the frame is supported by a plurality of wheels and the lifting device is self-propelled.

6. The lifting device of claim 1 wherein the center of gravity of the counterweight is horizontally offset from the pivot axis when the boom is pivoted perpendicular to the frame, thereby defining a moment arm for generating an anti-tipping moment.

7. The lifting device of claim 1 wherein the counterweight is connected to the boom below the pivot axis.

* * * * *